US007490860B2

(12) United States Patent
Didde

(10) Patent No.: US 7,490,860 B2
(45) Date of Patent: Feb. 17, 2009

(54) OPEN AND LAY-FLAT PRINTED BOUND BOOK OR BOOKLET AND METHOD OF BINDING

(75) Inventor: Carl Didde, Emporia, KS (US)

(73) Assignee: Industrial Building Corporation, Inc., Emporia, KS (US)

( * ) Notice: Subject to any disclaimer, the term of this patent is extended or adjusted under 35 U.S.C. 154(b) by 560 days.

(21) Appl. No.: 10/943,664

(22) Filed: Sep. 17, 2004

(65) Prior Publication Data

US 2006/0061083 A1 Mar. 23, 2006

(51) Int. Cl.
*B42D 5/00* (2006.01)

(52) U.S. Cl. ..... 281/40; 281/21.1; 412/6; 412/8; 412/16

(58) Field of Classification Search ..... 281/21.1, 281/15.1, 3.1, 29, 38, 40; 412/1, 8, 16, 19, 412/33, 37, 6
See application file for complete search history.

(56) References Cited

U.S. PATENT DOCUMENTS

| | | | | |
|---|---|---|---|---|
| 379,334 | A | | 3/1888 | Ryan |
| 438,067 | A | | 10/1890 | Dunn |
| 657,503 | A | | 9/1900 | Taylor |
| 1,042,707 | A | | 10/1912 | Mears |
| 1,715,658 | A | | 6/1929 | Howard |
| 1,741,269 | A | | 12/1929 | Alger |
| 1,747,581 | A | | 2/1930 | Frazier |
| 1,879,757 | A | | 9/1932 | Kusch |
| 1,897,839 | A | | 2/1933 | Gale |
| 2,176,815 | A | * | 10/1939 | Tannen ..... 493/353 |
| 2,455,971 | A | | 12/1948 | Bosch |
| 2,720,665 | A | | 10/1955 | Kile |
| 2,877,473 | A | | 3/1959 | Ehlermann |
| 3,292,951 | A | | 12/1966 | Schoenberger |
| 3,330,718 | A | | 7/1967 | James, Jr. et al. |
| 3,840,254 | A | * | 10/1974 | Shatzkin ..... 281/21.1 |
| 3,925,126 | A | * | 12/1975 | Leatherman et al. ..... 156/73.6 |
| 4,019,758 | A | * | 4/1977 | Heller et al. ..... 412/8 |
| 4,184,218 | A | * | 1/1980 | Hawkes ..... 412/8 |
| 4,201,615 | A | | 5/1980 | French |
| 4,206,532 | A | | 6/1980 | DeLorenzo |
| 4,893,979 | A | * | 1/1990 | Alpers ..... 412/4 |
| 5,078,424 | A | | 1/1992 | Kadish |
| 5,078,563 | A | * | 1/1992 | Lolli ..... 412/8 |
| 5,129,772 | A | | 7/1992 | Slautterback |
| 5,193,851 | A | | 3/1993 | Honegger |
| 5,207,456 | A | | 5/1993 | Danhoff |

(Continued)

*Primary Examiner*—Dana Ross
*Assistant Examiner*—Jamila Williams
(74) *Attorney, Agent, or Firm*—Hovey Williams LLP

(57) ABSTRACT

Improved lay-flat book products such as a book block (20) are provided which include a plurality of individual, marginally notched, alternating sheets (22, 24) having offset inner binding notches (30, 32); adhesive (36) is applied to essentially fill the notches (30, 32) in order to bind the sheets (22, 24) together. Preferably, tape (38) is applied to the spine surface (34) of the book block (20) and to adjacent portions of the outermost sheets thereof. Hard covers (48) and cloth binding (52) can also be added if desired. In a preferred method, a supply of marginally notched, unprinted A and B sheets (22, 24) are fabricated and the sheets may then be printed using digital equipment (e.g., programmable copiers) followed by adhesive binding. This permits economical production of short-run book products.

29 Claims, 7 Drawing Sheets

U.S. PATENT DOCUMENTS 5,261,769 A * 11/1993 Leclerc ..... 412/4
5,437,476 A 8/1995 Hutchinson
5,456,496 A 10/1995 Kadish
5,499,847 A 3/1996 Smith
5,605,425 A * 2/1997 Schaefer ..... 412/4
5,632,853 A * 5/1997 Montandon et al. ..... 156/578
5,672,030 A 9/1997 Dean
5,693,142 A 12/1997 Pedigrew et al.
5,722,628 A 3/1998 Menaged
5,868,539 A * 2/1999 Rathert ..... 412/5
6,632,059 B2 * 10/2003 Debrunner et al. ..... 412/8
6,739,816 B1 * 5/2004 Schuder et al. ..... 412/4
7,048,269 B2 * 5/2006 Hoarau ..... 270/52.17
2002/0182033 A1 * 12/2002 Weiss ..... 412/1

* cited by examiner

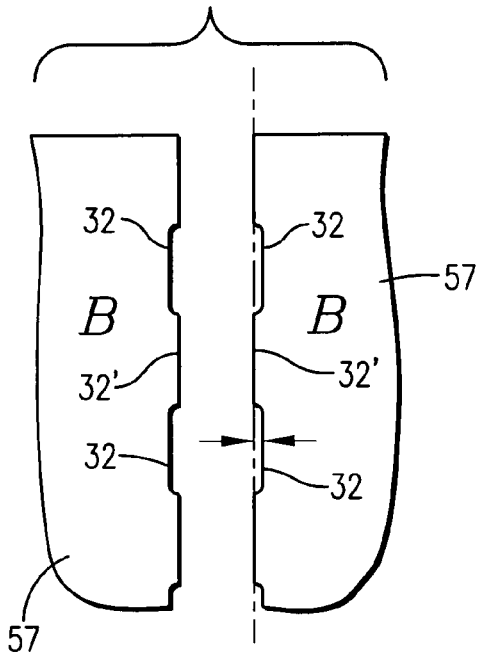
FIG. 4.
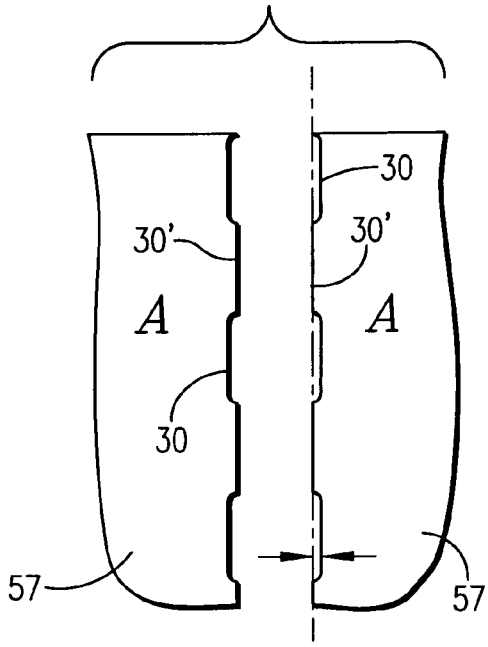
FIG. 5.
FIG. 6.
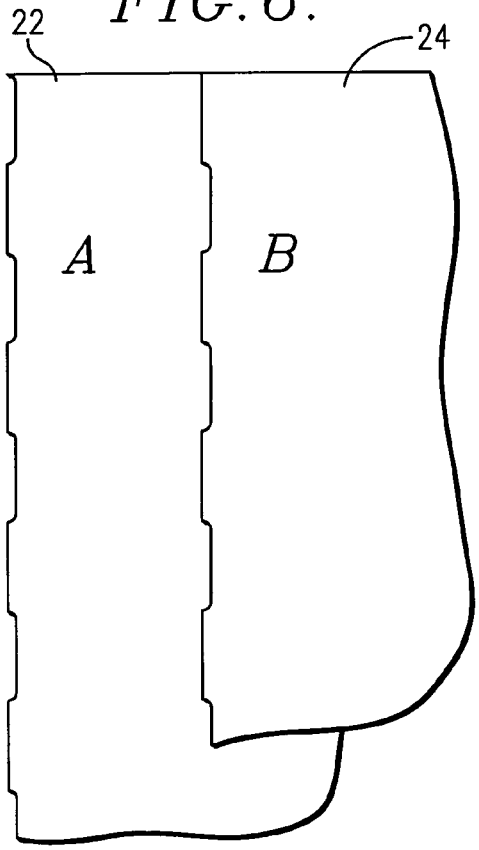
FIG. 3.
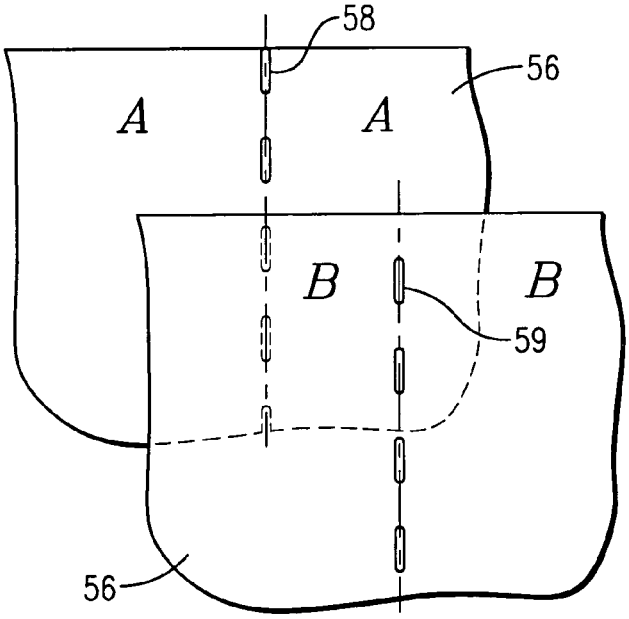

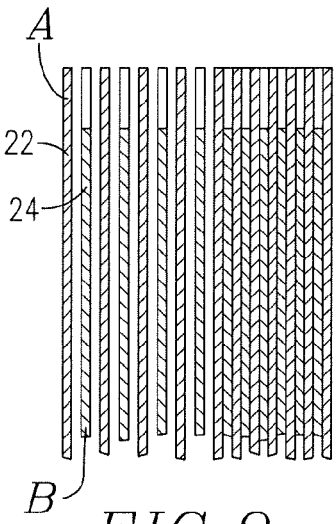
FIG. 9.
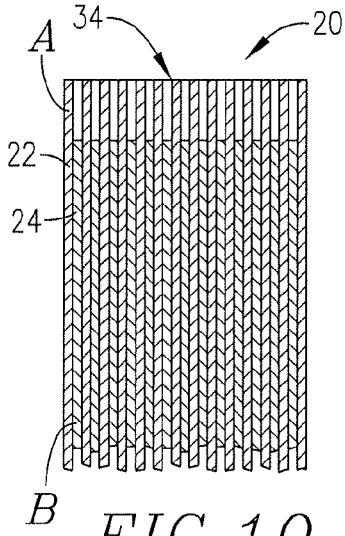
FIG. 10.
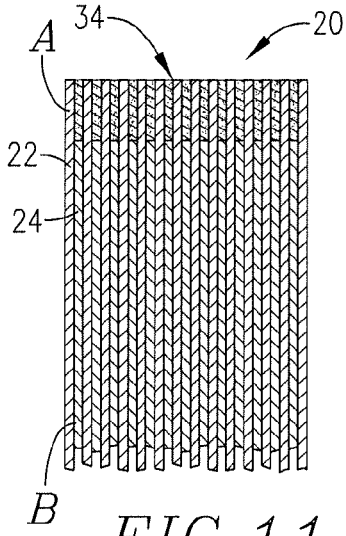
FIG. 11.
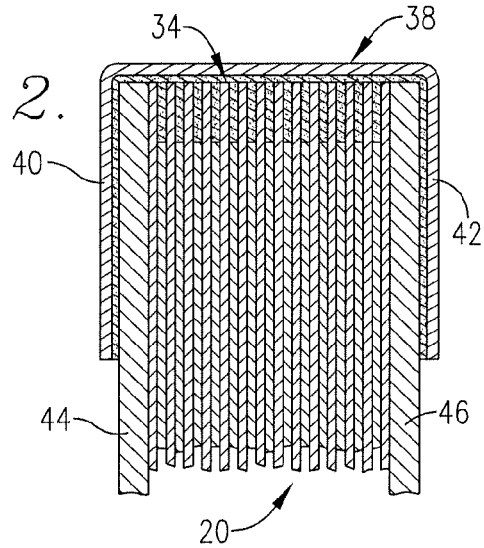
FIG. 12.
FIG. 14.
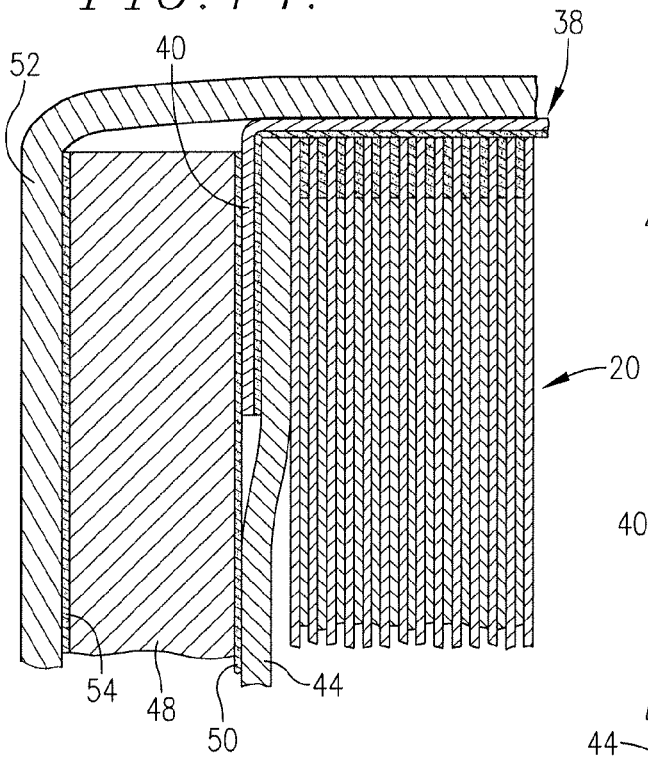
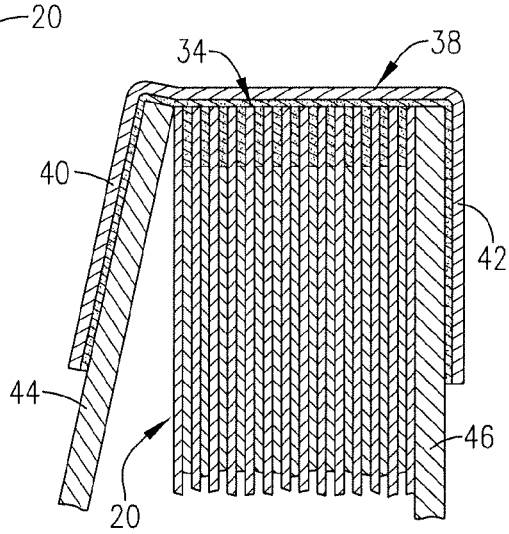
FIG. 13.

OPEN AND LAY-FLAT PRINTED BOUND BOOK OR BOOKLET AND METHOD OF BINDING

BACKGROUND OF THE INVENTION

1. Field of the Invention

The present invention is broadly concerned with improved lay-flat book products which can be rapidly and easily manufactured, even with small run quantities, as for example, of the order of 100 to 1,000 copies. More particularly, the invention is concerned with such lay-flat books as well as methods of production thereof, wherein the book is made up of a series of juxtaposed individual sheets each having a binding edge which is notched; the sheets are placed in an alternating relationship with offset notch patterns, and are preferably interconnected by application of a cold set glue into the notches with the thickness of any glue remaining on the spine being insufficient to inhibit the lay flat characteristics of the sheets of the book product. A relatively thin, flexible spine cover is adhesively secured to the spine of the book contents in close conforming relationship to the spine. In one embodiment of the invention, the spine cover is a length of flexible tape having a width somewhat but not substantially greater than the thickness of the contents of the book that is secured to the spine by an adhesive. In an alternate embodiment, the spine cover is U-shaped, flexible paper sheet material having sides equal in area to that of the sheets and a central portion of the same size as the spine. The central portion of the full cover is adhesively secured to the spine of the book contents. The spine cover preferably has a pre-applied adhesive such that the spine cover will closely adhere to the spine of the book contents without interfering with the lay flat opening properties of the book. The books of the invention may be produced in soft or hard cover versions without detracting from the lay-flat capability thereof.

2. Description of the Prior Art

Books and periodicals are commonly bound in a "perfect binding" method wherein a plurality of pre-printed sheets of paper are gathered together in a book block. The uncut spine of the book block is then abraded or notched to create a roughened glue-receiving surface. Glue is applied along the abraded spine and a cover is applied over the book block. Other types of prior binding methods include sewing the signatures together in the well known Smythe Sewn method or attaching the signatures or sheets together with staples.

A significant problem with all of these prior art binding methods is that the books created therefrom do not open fully and lay flat. There are a large number of variables involved in any effort to produce a lay-flat book, book block or booklet, including size and number of pages, quantity and quality of print, reliability and durability of the product, and the different makeup of all plants that choose to produce this type of product with present methods of binding. Specifically, when books created by any of these prior art methods are opened, the pages assume a decidedly arcuate shape adjacent the bound edge, making it difficult for the reader to hold the book open and read the printed text that is adjacent the bound edge. This is a problem with all types of books, but is especially problematic with instruction manuals, cookbooks, workbooks, textbooks, and other types of books that are read while the reader carries on other tasks with his or her hands.

Some prior art attempts have been made to create books that open and lay flat. An early patent to Ryan, U.S. Pat. No. 379,334 of Mar. 13, 1888 illustrates and describes a book composed of sections in which each section is secured to the back separately and thereby flexibly independently of the others leaving the leaves flexible at a line parallel to and at a sufficient distance from the back to allow each to lie flat upon the others when open. However, this method relies upon the concept of creasing the individual sheets making up the book to form separate V-portions, interleaving the creased V-portions, and then joining the V-portions by stitching. The creasing and stitching operations as disclosed in the Ryan '334 patent not only are expensive and largely impractical in high-speed book binding operations, but the appearance of the open book as illustrated in the drawings of the patent is not desirable.

Kadish in U.S. Pat. No. 5,456,496 of Oct. 10, 1995 discloses a book and method of binding in which the pages are described as laying flat upon opening of the book. However, in order to accomplish this desired function, the patentee provides a woven tabbed tubular ribbon with the individual sheets being adhesively attached to the ribbon. The tubular ribbon allows the bound edges of the pages to move away from the spine of the book when the book is open, thus permitting the pages to lay relatively flat. Unfortunately, this and other prior art methods of binding books so that they open flat are complicated, time consuming, and costly and are therefore not economically feasible for many types of printed material.

U.S. Pat. No. 1,715,658 describes the production of check books making use of alternating sheets having offset notches along the binding edges of the sheet. However, these notches are of significant depth and length, and would not be suitable for a lay-flat book of general purpose. Moreover, the use of conventional hot melt adhesives in the production of check books would detract from any lay-flat capability thereof.

SUMMARY OF THE INVENTION

The present invention overcomes the problems outlined above and provides a lay-flat book product such as a book block, complete book, booklet or periodical (as used herein "book" is intended to encompass all such products). Broadly speaking, the books of the invention are made up of a plurality of individual sheets presenting the binding margin with the sheets being in face-to-face adjacency such that the binding margins define a relatively flat spine surface. Each of the binding margins includes a series of spaced apart glue-receiving notches along the length thereof, with the notches on each sheet being offset from the notches of the immediately adjacent sheet on either side thereof. In order to bind the sheets for lay-flat opening, an adhesive is applied within the notches with the amount of glue left remaining on the spine of the book contents being limited such that upon setting of the glue it does not interfere with the full lay flat opening of the book.

In preferred forms, the glue used for binding is a cold set glue not requiring heating for application. Typical types of glue of this character are the polyvinyl acetate-based glues which dry by evaporation of water to form sturdy, yet flexible bonds. Such glues commonly have a viscosity on the order of 5600 cps and a pH of 4-5. It has been found that use of cold set glues materially improves the lay-flat capability of the resultant books, as compared with conventional hot melt glues.

In addition, it is preferred that a flexible spine cover such as tape or a full cover sheet be applied over the initially generally flat spine of the adhesive-bound book such that the tape overlies the spine surface as well as at least a portion of the opposed outermost individual sheets and/or end sheets. The tape spine cover may be paper or other flexible material and preferably is of somewhat thicker stock than the sheets of the contents of the book. In lieu of the tape, a full cover sheet may be placed over the book contents with only the central portion of the cover sheet being adhesively secured to the book contents and narrow areas along the edges of the spine. The tape or the cover sheet used as an alternative for the tape serves to maintain the sheet of the book contents in close adjacent relationship without separation of the individual sheets that could otherwise occur before setting up of the glue. Furthermore, the tape or full cover sheet secured to the spine of the book contents provides support for the spine without interfering with the ability of the final book product to open with lay flat pages, prevents relative lateral shifting of the sheets until the glue has fully setup.

Better results are also found with careful selection of the length and depth of the marginal sheet notches. In particular, notches should have a length of from about ⅛-½ inches and a width of from about 1/32-3/32 inches. More preferred dimensions are a length of about ¼ inch and a depth of about 1/16 inch.

An economical method of producing a book in accordance with the invention comprising the steps of first fabricating an unprinted web having a series of spaced apart openings along the length thereof, commonly by use of conventional web fed processing equipment. The web is then cut to produce individual marginally notched sheets. This can be done by first axially cutting along the center line of the openings or slots to create marginally notched half-webs, and the half-webs are cross-cut to create A and B sheets having marginal notches, wherein the notches of the A sheets are offset from the notches of the B sheets. At this point the A and B sheets are printed preferably using digital equipment such as one or more programmable copiers. The printed sheets are then collected to form a book with alternating A and B printed sheets in face-to-face adjacency and with the notched edges thereof in alignment to define a spine surface. Soft covers may then be added to the book block. Finally, adhesive is applied to the spine edge of the book block to furnish a quantity of glue introduced into the notches. Then the spine cover tape or full cover for the book product is applied to the spine edge of the book contents.

BRIEF DESCRIPTION OF THE DRAWINGS

FIG. 3 is a greatly enlarged, fragmentary view depicting pairs of A and B sheets from FIG. 1, and further showing the cut lines which create the notched A and B sheets;

FIG. 4 is a greatly enlarged, fragmentary view depicting the separation of a pair of B sheets along the cut line to form notched B sheets;

FIG. 5 is a greatly enlarged, fragmentary view depicting the separation of a pair of A sheets along the cut line to form notched A sheets;

FIG. 6 is a fragmentary view illustrating the offset notch pattern between A and B sheets;

FIG. 9 is a fragmentary sectional view illustrating the formation of the book block depicted in FIG. 8;

FIG. 10 is a view similar to that of FIG. 9, but showing the book block fully assembled and prior to gluing thereof;

FIG. 11 is a view similar to that of FIG. 10, but showing the book block after application of glue to the glue-receiving notches;

FIG. 12 is a view similar to that of FIG. 11, but showing the application of a pair of side marginal, unnotched sheets on opposite sides of the book block, with flexible tape applied to the spine and outer portions of the unnotched sheets;

FIG. 13 is a view similar to that of FIG. 12, but depicting opening of the cover of a book;

FIG. 14 is a view similar to that of FIG. 13, but further illustrating a hard cover adhesively applied to the flexible tape and a unnotched marginal sheet, and with cloth binding applied over the hard cover and flexible tape;

DETAILED DESCRIPTION OF THE PREFERRED EMBODIMENT

Figure 8:
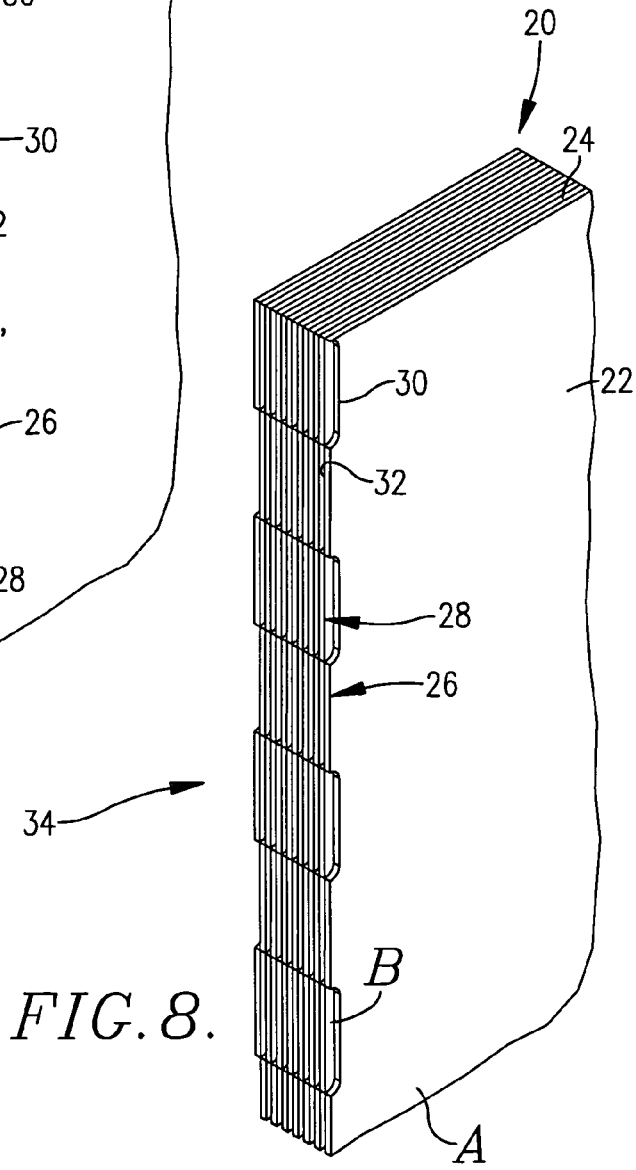
FIG. 8 is a perspective view similar to that of FIG. 7, but showing the A and B sheets in face-to-face adjacency to form a book block.
Figure 20A:
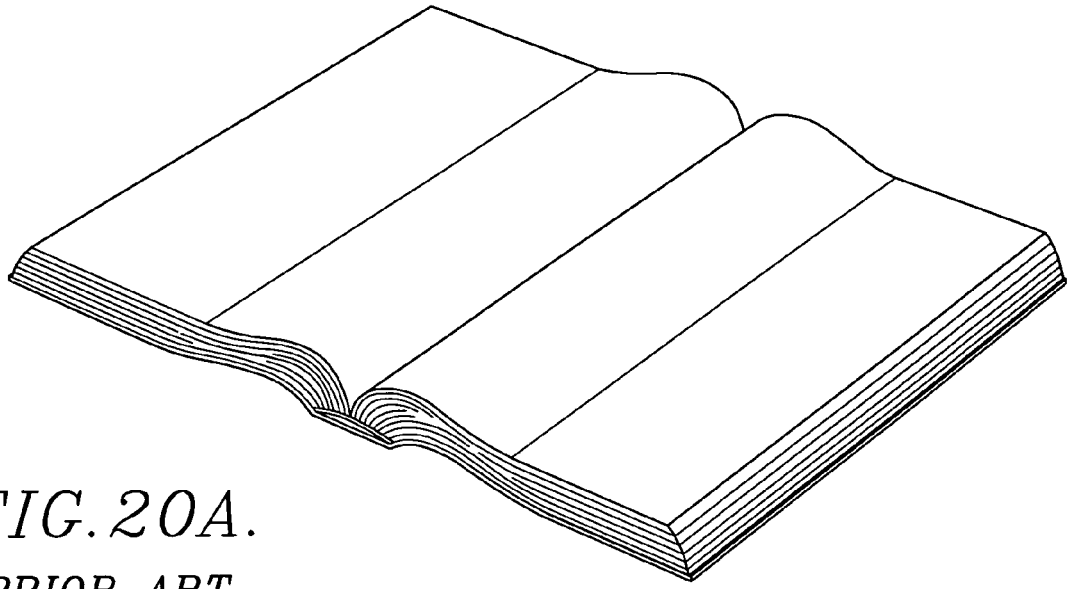
FIG. 20A. PRIOR ART
FIG. 20A is a perspective view of a conventional prior art perfect bound soft cover book in an opened position, and illustrating the lack of lay-flat capability.
Figure 20B:
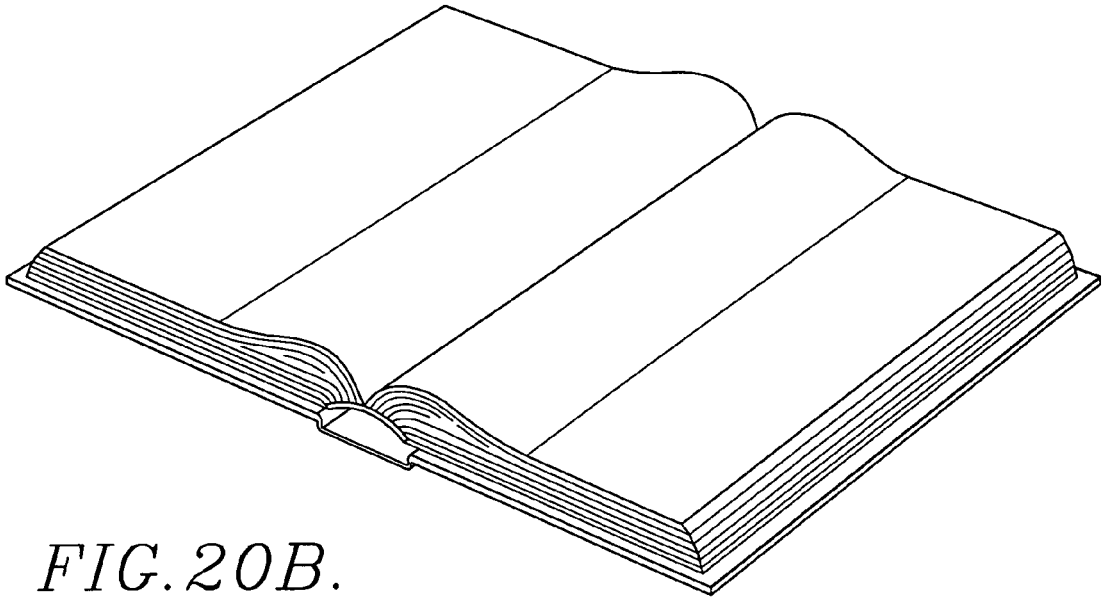
FIG. 20B. PRIOR ART
FIG. 20B is a perspective view of a conventional prior art perfect bound hard cover book in an opened position, and illustrating the lack of lay-flat capability.

The present invention is directed to the production of lay-flat book products such as a book block 20 illustrated in FIGS. 8-10. As explained previously, prior art soft cover and hard cover books suffer from an inability to lay flat on a desk or other convenient surface. This problem is illustrated in FIGS. 20A and 20B, where it will be seen that the pages of the books assume an arcuate configuration, particularly adjacent the inner bound edges thereof.

Broadly speaking, the book block 20 of the invention includes a plurality of face-to-face, juxtaposed, alternating individual sheets referred to as A and B sheets 22,24. Each of the A and B sheets presents a inner binding margin 26 and 28 provided with a series of axially spaced apart and inwardly extending notches 30 and 32, with corresponding tabs 30' and 32' between the notches. It will be seen that the notches 30 provided in the A sheets are axially offset relative to the notches 32 formed in the B sheets. Moreover, the sheets 22, 24 collectively define a spine surface 34.

The sheets 22, 24 are typically imprinted with desired text to form consecutive pages for a book or other similar product. In order to bind the individual alternating sheets 22, 24 together, glue 36 is applied into the notches 30, 32 whereby the tabs 30' of the A sheets are bound together and similarly the tabs 32' of the B sheets are adhered together. Preferably, the adhesive used is a cold set polyvinyl acetate-based glue. The glue is applied so that the respective notches are essentially completely filled, with the glue remaining on the spine surface 34 being of a thickness such that it does not impede or significantly interfere with the ability of all opposed sheets to open and lay flat substantially when the book product is opened. This condition is best seen in FIG. 11. The resultant bound book block 20 is capable of being opened at any of the pages thereof and will lay flat on a supporting surface, with little or no tendency for the book block to close.

Figure 15:
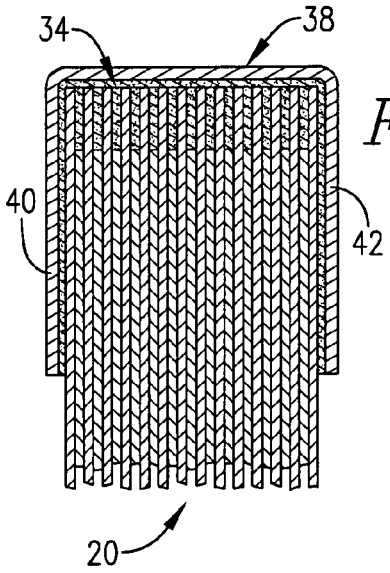
FIG. 15 is a fragmentary sectional view illustrating a book made up of the book block of FIG. 8 with flexible tape applied over the spine surface and portions of the outermost sheets of the book block.
Figure 16:
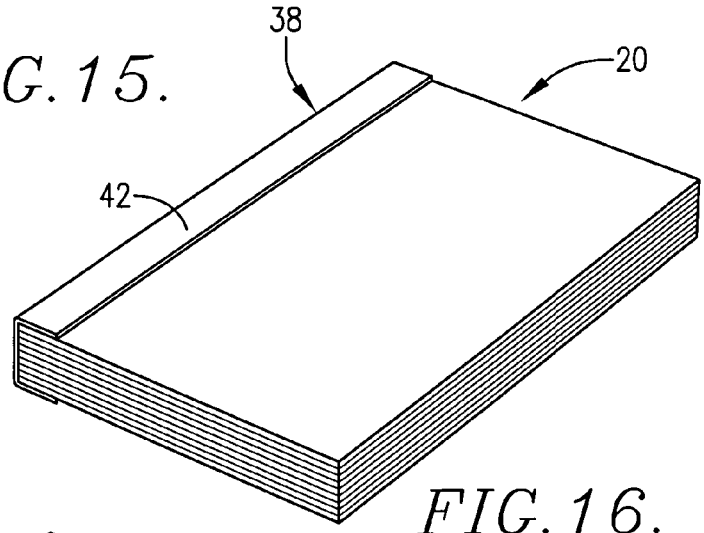
FIG. 16 is a perspective view of the complete book shown in FIG. 15.
Figure 17A:
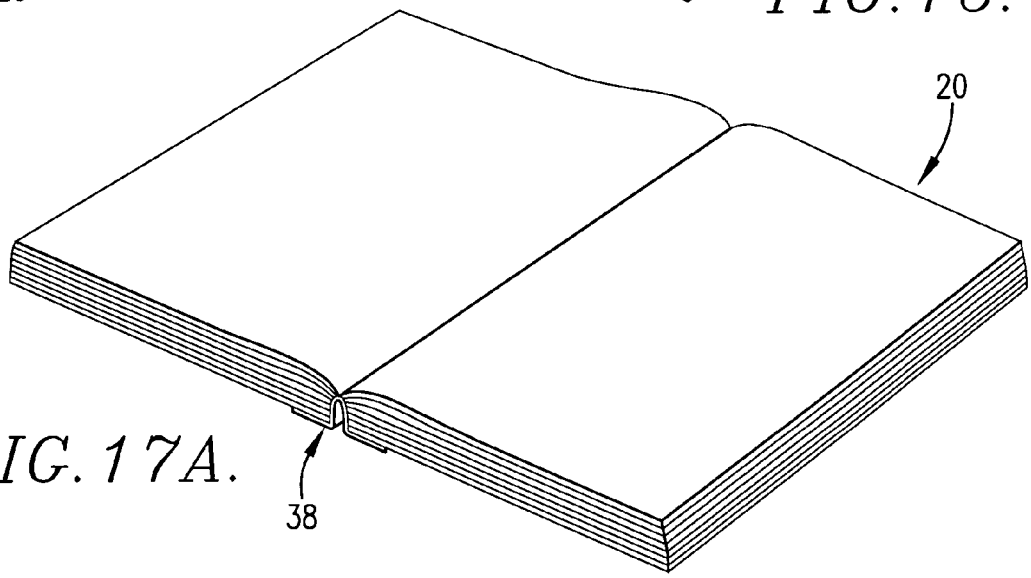
FIG. 17A is a perspective view of the FIG. 16 book, shown in an opened, lay-flat configuration.

An elongated stretch of flexible tape 38 is adhesively applied along the spine surface 34 and forwardly extending portions 40 and 42 of the outermost sheet of the book block 20 as illustrated, for example, in FIGS. 15 and 16. The preferred adhesive is the same cold set adhesive previously described. The adhesive may be applied to the tape 38, which is then secured to the spine of the contents of the book before the adhesive sets up. The tape 38 should be of a width such that it overlaps opposite sides of the assembled book contents at least about 1/16 in. A preferred tape material is of 80 pound stock paper, although the tape 38 may be of other flexible material such as a cloth, or a synthetic resin including woven rayon or polyester, or other similar woven or non-woven plastic film products that will accept a cold set adhesive. Use of tape strengthens the resultant book product without detracting from the lay-flat capability thereof. This is shown in FIG. 17, where the book block 20 having the tape 38 applied is opened and lays flat. The tape 38 also serves the function of preventing separation of the sheets 22, 24 of the contents of the book one from another and thereby maintaining the sheets in close assembled relationship. In addition, the tape 38 serves to prevent lateral shifting of the sheets so that the initial relatively flat spine surface is maintained until the cold set glue has substantially solidified while maintaining its flexible, memory retaining properties. A full cover for the book adhesively secure to the spine of the book serves a similar function.

Further options for the book block 20 include the provision of thicker side marginal sheets 44 and 46 which may be in the form of fly leaves or soft covers (see FIGS. 12-13). In this embodiment, the margin sheets 44 and 46 are secured to the book block 20 by means of the tape 38. In this instance, however, the side marginal portions 40 and 42 of the tape are directly adhered to the outer surfaces of the sheets 44,46, and this forms the sole attachment of the latter. This is depicted in FIG. 13, where it will be seen that the sheets 44 and 46 are separable from the book block 20.

Figure 17B:
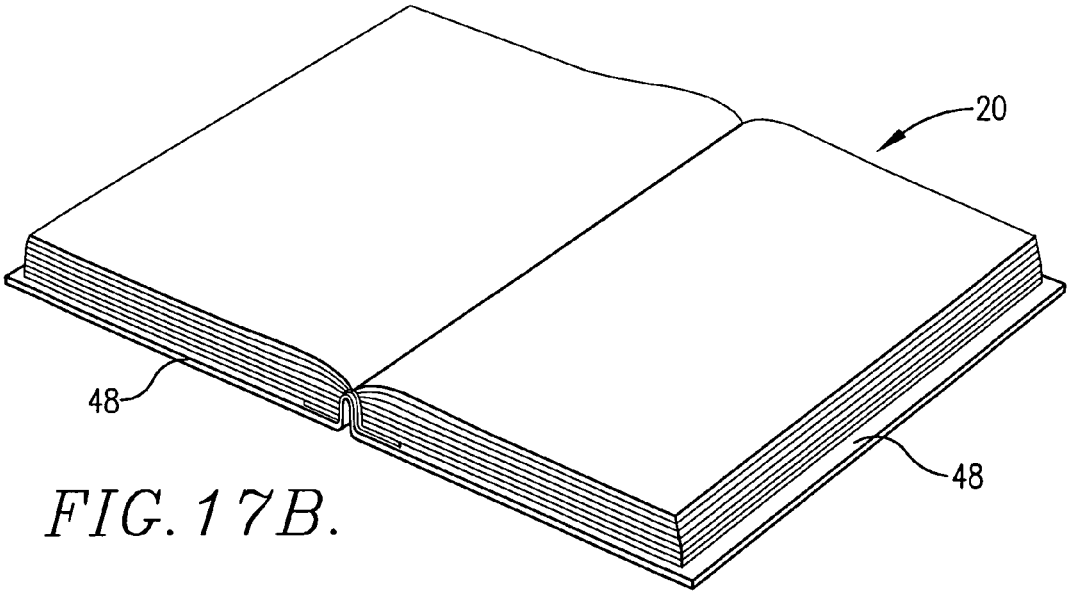
FIG. 17B is a perspective view similar to that of FIG. 17A, but showing the hard cover bound book of FIG. 14 in an opened, lay-flat configuration.

It is also possible to employ hard covers with the book block 20. This is illustrated in FIG. 14, which depicts a construction similar to that of FIG. 12, but including a pair of hard covers 48. The hard covers 48 are attached by means of adhesive 50 applied along the inner face thereof and engaging the out surface of the tape portions 40, 42 and also the out faces of the flexible sheets 44, 46. A cloth binding cover 52 may also be applied to the hard covers 48 and the spine of the book block. Such a binding cover 52 (which is normally a flexible cloth) is secured by means of adhesive 54 applied to the out surfaces of the hard covers 48. Use of the hard covers 48 does not detract from the lay-flat characteristics, as shown in FIG. 17B.

Best results are produced when using the notched sheets having relatively small depths and lengths. The most preferred notch configuration is a length of about 1/4 inch and a depth of about 1/16 inch. The tab areas between the individual notches is likewise about 1/4 inch. Longer and deeper notches, such as those depicted in U.S. Pat. No. 1,715,658, detract from the desirable lay-flat characteristics of the final products.

Figure 1:
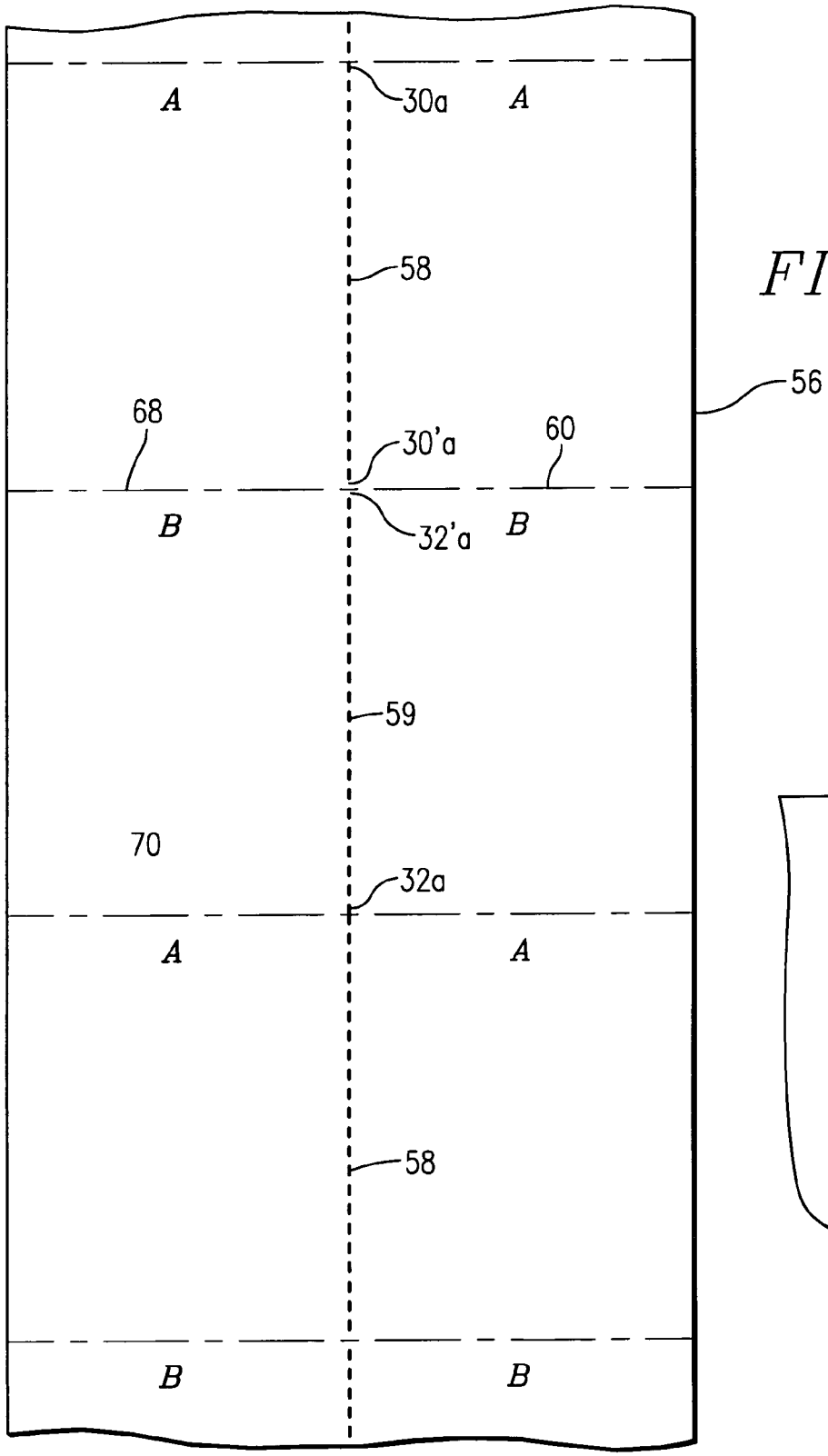
FIG. 1 is a plan view of a section of web fabricated in accordance with the invention to present a series of spaced apart, axially aligned apertures along the length thereof.

A preferred method in accordance with the invention involves initial preparation of a supply of prefabricated and unprinted A and B sheets 22, 24. This is most economically accomplished using web-fed processing equipment which first creates a series of axially spaced apart central slots along the length of the web, and then cuts the web to create the final sheets having the notched patterns described above. In one preferred case, a 22-inch slotting cylinder can be used to process 17-inch wide webs of paper. This creates desirable 8½ inch×11 inch A and B sheets. Referring to FIG. 1, such a web 56 is illustrated after initial processing to form the axially spaced apart central slots 58 of sheets A-A and slots 59 of sheets B-B. Cross-cut lines 60 are shown on the web 56 to illustrate how the A and B sheets with the different notch patterns are created. Normally, the web 56 is first axially cut along the center line of the slots 58 as shown in FIG. 3, whereupon the resultant half-webs 57 are cross-cut to create the final sheets 22 and 24. It will thus be appreciated that the originally cut slots 58 are essentially bifurcated by the axial cutting step, and that the offset notch pattern between the A and B sheets is created by strategic cross-cutting of the half-webs 57 (see FIGS. 4 and 5).

Figure 2:
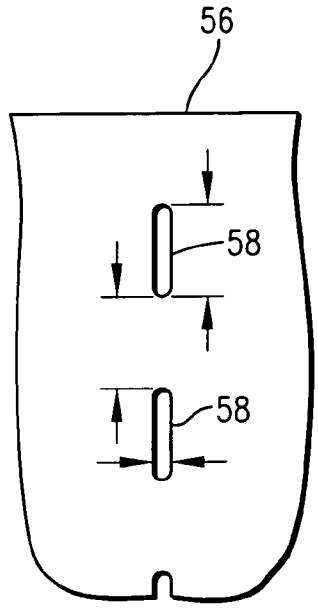
FIG. 2 is a fragmentary, greatly enlarged view illustrating a pair of adjacent apertures from FIG. 1.
Figure 7:
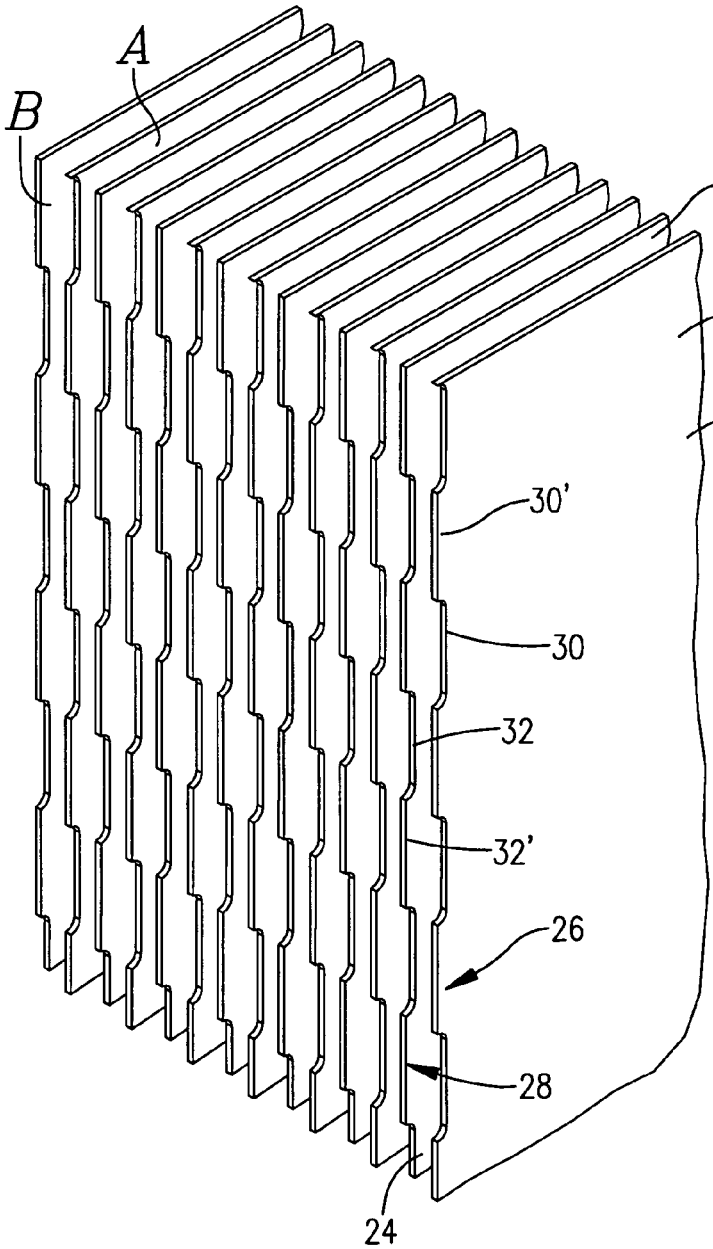
FIG. 7 is a perspective view showing a plurality of alternately arranged A and B notched sheets.
Figure 18:
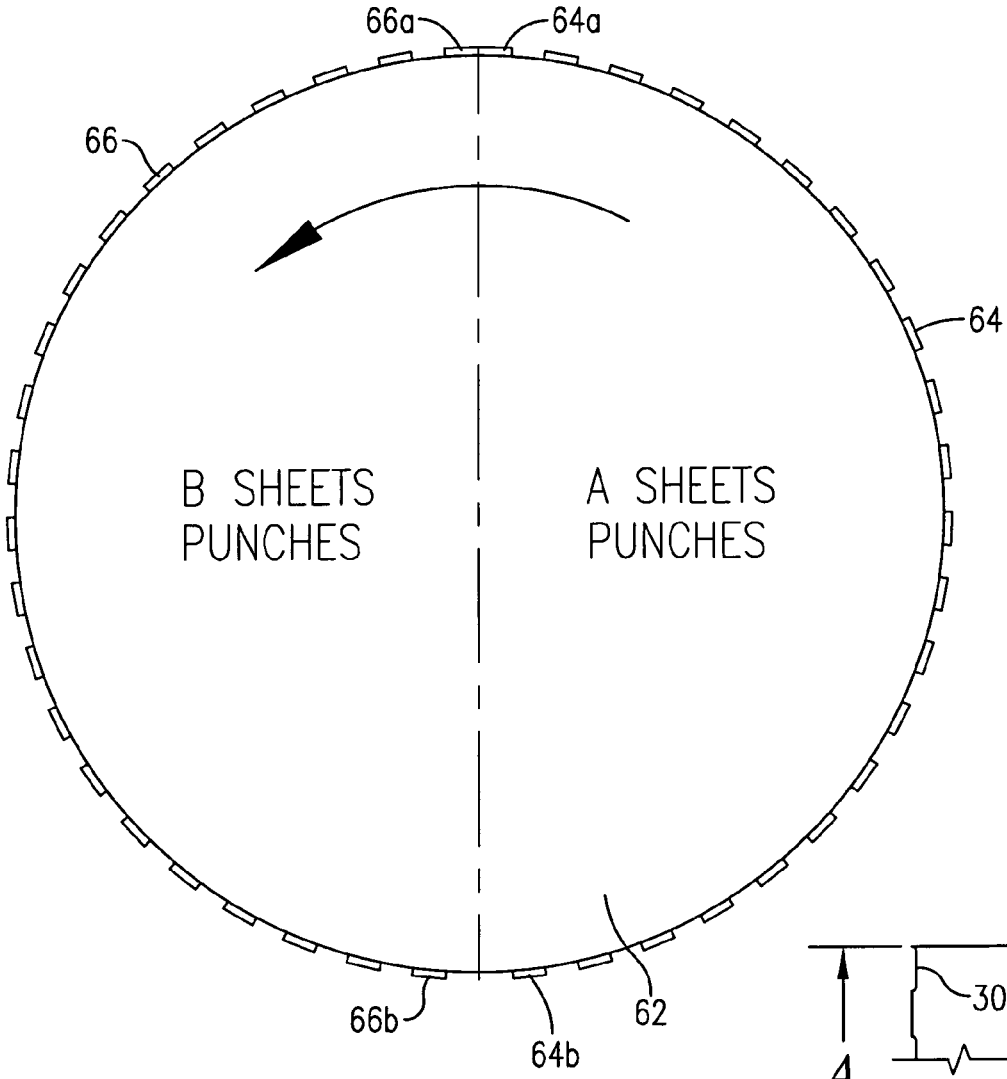
FIG. 18 is a schematic representation of a punch cylinder for forming a line of slots, which when divided become notches on opposed successive sheets A and B.
Figure 19:
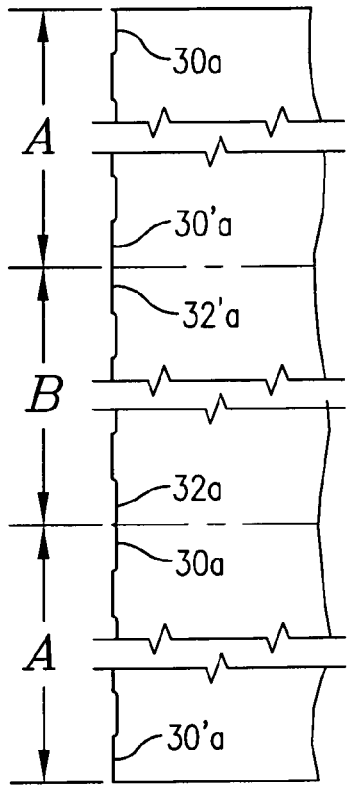
FIG. 19 is a schematic representation of successive notches in sheets A and B formed by the punch cylinder after longitudinal slitting of the web.

As shown schematically in FIG. 18, a punch cylinder 62 having a nominal circumference of 22 in. has a series of A sheet punches 64 around one half of the circumference thereof, and a series of B sheet punches 66 around the remaining one half of the circumference of the cylinder. The punches 64 and 66 are aligned around cylinder 62 and located midway between the ends of the cylinder 62. Each of the punches 64 and 66 is of elongated configuration approximately 1/4 in. in length and of a width from about 3/32nd in. to about 1/8th in. The ends of each punch 64 and 66 are preferably of semi-circular configuration to form notches 58 of the shape illustrated in FIG. 2. Schematic FIG. 19 illustrates the notches 30 and 32 and corresponding tabs 30' and 32'. It can been seen from FIG. 18 that the two uppermost punches 64*a* and 66*b* are in close proximity to one another, while the lower most punches 64*b* and 66*b* of the schematic drawing 18 are spaced apart a distance approximately equal to twice the length of one of the slots 58 formed by a punch 64 and 66. Accordingly, the punch 64*a* as depicted in FIG. 18 forms a slot 58 that becomes a notch 30*a* at the uppermost extremity of the uppermost A sheet as illustrated in FIG. 1. Likewise, the lowermost punch 64*b* is disposed to leave a tab 30'*a* at the lower edge of that uppermost sheet A. The punch 66*b* on the B sheet punch side of cylinder 62 is spaced from the punch 64*b* a distance equal to two times the length of each punch such that upon division of the lower notch 59, a notch 30*a* is left in the uppermost sheet B as shown in FIG. 1. Likewise, the punch 66*a* of the B sheet side punches of cylinder 62 forms a slot 59 in the uppermost sheet B of FIG. 1 that becomes a notch 32*a* in the uppermost B sheet of FIG. 1.

Therefore, as shown schematically in FIG. 19, when the web of FIG. 1 is cross slitted along the dash dot line 68 to separate sheets A and B and along the dash dot line 70 to separate sheets B and A, it is to be observed from FIG. 19 that the notches 30*a* and tabs 30'*a* of a sheet A are offset from the notches 32*a* and tabs 32'*a* of an adjacent sheet B. The cross slitting knifes are located on a cylinder in circumferential disposition to form sheets A and B that maybe respectively 11 in. long or in the alternative 7 in. long.

The slotted web 56 is preferably directed to a longitudinal slitting station of the web press having a slitting cylinder with a circumferentially extending slitter knife again located midway between the ends of the slitting cylinder wherein the knife is cooperable with an opposed anvil cylinder. The slitting knife is accurately located to cut each of the slots in half to form the notches 58 and 59. Circumferentially slitter knives may also be provided on the slitter cylinder outboard of the central slitter knife to provide a web of exact width, e.g. 17 in. for 8½ in. wide sheets A and B, or 10 in. for 5 in. wide A and B sheets.

Once a supply of notched A and B sheets is created, they can be utilized to quickly and economically produce all types of book products. This procedure first involves printing the prefabricated notched sheets with text or other book product content. The printing is desirably carried out using digital equipment such as one or more programmable copiers which are capable of printing on both sides of the sheets and applying page numbers.

After printing, the sheets are collected and jogged using a jogging procedure to assure full alignment of the sheets with the spine surface defined by the notched edges of the sheets being essentially flat as shown in FIG. 11. Same size binder boards may be used at top and bottom to assist in aligning the sheets. The assembled book contents are then placed on a suitable work surface. A weight is then placed on top of the stack to assure stability. Glue is then applied with a brush along the spine surface of the book. Two or three coats of glue are preferably applied at 30-minute intervals, making sure that the glue is brushed well into the notches. After each glue application the spine surface may be scraped leaving only a thin layer of the cole set glue on the spine surface outside of the notches. In automated processing, the individual book blocks may be passed through a gluing station where a stiff glue brush is used along with a scraper or doctor blade adjacent the brush. In all instances, the goal is to essentially fill the notches while leaving at most a very thin film of adhesive over the remaining spine surface of the block.

After the glue is set (approximately 2 hours for the preferred cold set glue), the binder boards can be removed for reuse. Next, the tape or full cover sheet is applied. Normally, it is easier to put glue on the tape or full cover sheet first followed by application to the spine and portions of the front and back pages (or covers if used) of the book block 20. Care should be taken to assure that the tape is smooth and unwrinkled, and is tightly secured all around. The book product is now finished and is ready for application of hard covers if desired.

A major advantage of the book and method of production is the ability to use conventional programmable copy machines for printing of the individual sheets making up a book or periodical. Long run publications involving thousands to millions of copies are typically prepared by printing the images on the web on a web fed press. The printed images are arranged and organized such that upon cutting the web into predetermined lengths that each length may be folded into signatures made up of eight or more printed pages. The signatures are edge cut to size, collated, and the assembled books and periodicals directed through equipment to roughen the spine of the product, a hot melt glue is applied and a cover placed over the assembly. This multi-step, multiple equipment printing and binding process is economical for very long runs, but not practical for short runs that may be as little as 100 to 1,000 editions.

The availability of programmable copy machines that are designed to copy images on paper sheets of predetermined dimensions (5½×8½ in. or 8½×11 in. which are standard operating sizes on many digital copy machines and are typical for many books and publications) are uniquely capable of being used economically and practically to produce short run printed publications in accordance with this invention. After sheets A and B are assembled in successive order with the number of sheets being equal to the number of pages of the book or publication to be prepared, the book thereby form may be place in a digital programmable copy machine that has been preprogramed with the images to be printed in successive order in the copy machine memory. The copy machine is setup in the conventional mode to print images on both sides of each sheet. Accordingly, if for example a book contains 100 two sided pages, the 200 images to be printed are digitally copied into the memory of the copier for printing on first one side and then the opposite side of successive sheets.

As a result, no collation of the sheets making up a book or periodical is required because the number of sheets of each publication is placed in the copy machine for reproduction. When that copy job is completed then a requisite number of sheets for the next publication is placed in the copier. This process is repeated until the number of books for a particular order have been printed. The books are then bound as previously described. One further advantage of this invention is the fact that a bank of copiers may be used to produce printed books, with the number of operators for the copiers being limited because the only requirement is replacement and removal of a specific stack of sheets in each copier. By staggering the operation of the copiers, the operator may simply move from copier to copier in sequence as each copier job is completed.

I claim:

1. A lay-flat book comprising:

a plurality of individual notched sheets including multiple A sheets and multiple B sheets, with each sheet presenting a binding margin, said A and B sheets alternating in order and being in face-to-face adjacency, said binding margins of the notched sheets being aligned to cooperatively define a generally flat spine surface of the book contents, each of said binding margins of the A and B sheets having a series of spaced apart, glue-receiving notches along the length thereof that define corresponding sheet tabs between the notches, the notches in each A sheet and the tabs therebetween being of the same length and width as the notches and respective tabs in each B sheet, the tabs in the A sheets being fully offset from the tabs of the immediately adjacent B sheets on either side thereof, the tabs of respective A sheets having a B sheet therebetween, and the tabs of respective B sheets having an A sheet therebetween being disposed in directly opposed, facing, aligned relationship, such that the notches of each A sheet are fully and directly aligned with respective tabs of adjacent B sheets and the notches of each B sheet are fully and directly aligned with respective tabs of adjacent A sheets, said tabs of the notched sheets each presenting a generally linear outermost edge, said outermost edges of the tabs being substantially disposed in a common plane that defines the spine surface; and a sufficient amount of flexible adhesive being provided within said notches of the A and B sheets to flexibly bond the directly opposed, fully aligned A sheet and B sheet tabs, respectively, to an extent allowing all opposed sheets to open and to substantially lay flat when the book is opened.

2. The book of claim 1, each of said notches being from about ⅛-½ inches in length.

3. The book of claim 2, said notches having a length of about ¼ inch.

4. The book of claim 1, each of said notches having a width of from about 1/32 to about 3/32 of an inch.

5. The book of claim 4, said notches having a width of about 1/16 of an inch.

6. The book of claim 1, said adhesive comprising a polyvinyl acetate-based flexible glue.

7. The book of claim 1, including a pair of unnotched flexible sheets respectively disposed adjacent the outermost notched sheets of said book.

8. The book of claim 7, said unnotched sheets being separable from the adjacent outermost notched sheet of said book.

9. The book of claim 7, including hard covers located adjacent each of said unnotched sheets, said hard covers being adhesively secured to said unnotched sheets and to portions of said flexible tape.

10. The book of claim 9, including cloth binding secured to the outer surface of said covers and in covering relationship to said spine.

11. The book of claim 7, including hard covers on opposite sides of said unnotched sheets, with cloth binding applied over said hard covers and in covering relationship to said spine.

12. The book of claim 1, wherein is provided a relatively thin, flexible spine cover having a central portion overlying and adhesively secured to substantially all of the spine surface of the book in generally conforming relationship thereto.

13. The book of claim 12, wherein said spine cover is a length of flexible tape.

14. The book of claim 13, wherein said spine cover is a U-shaped full cover sheet.

15. The book of claim 13, said tape extending from said spine surface a distance along the outer sheets of said book contents a distance of at least 1/16 inch.

16. The book of claim 13, including a pair of unnotched flexible sheets respectively disposed adjacent the outermost notched sheets of said book.

17. The book of claim 16, including hard covers located adjacent each of said unnotched sheets, said hard covers being adhesively secured to said unnotched sheets and to portions of said flexible tape.

18. The book of claim 17, including cloth binding secured to the outer surface of said covers and in covering relationship to said spine.

19. The book of claim 1, wherein the sum total of the lengths of the tabs of each of the A and B sheets is equal to one-half of the total length of the spine margin of each of the sheets.

20. A method of producing a book comprising the steps of:

fabricating an imprinted web having side margins and being provided with a series of spaced apart; elongated, longitudinally aligned openings along the length of the web midway between the margins thereof, a certain number of to openings presenting a first line of openings, and an equal number of openings presenting a second line of openings wherein to distance between to first line of openings and the second line of openings is approximately twice the length of one of the openings, the openings in each of said first and second lines thereof being of the same length and spaced apart the same distance;

cutting said web longitudinally of the lines of openings and midway of the width thereof to define a plurality of individual notched sheets including multiple A sheets and multiple B sheets, with each sheet presenting a notched binding margin having corresponding sheet tabs between respective notches, the notches in each A sheet and the tabs therebetween being of the same length and width as the notches in respective tabs in each B sheet and the tabs in the A sheets being fully off set from the tabs in the B sheets;

positioning the A and B sheets in alternating face-to-face adjacency with the binding margins thereof aligned to cooperatively define a book block having a generally flat spine surface, wherein the tabs of respective A sheets having a B sheet therebetween and the tabs of respective B sheets having an A sheet therebetween are disposed in directly opposed, aligned relationship, such that the notches of each A sheet are fully and directly aligned with respective tabs of adjacent B sheets and the notches of each B sheet are fully and directly aligned with respective tabs of adjacent A sheets, said tabs of the notched sheets each presenting a generally linear outermost edge;

disposing said outermost edges of the labs in a generally common plane that defines the spine surface; and applying a sufficient amount of flexible adhesive to the generally flat spine surface of the book block to cause adhesive to enter said notches of the A and B sheets and flexibly bond the directly opposed, aligned A sheet and B sheet tabs, respectively, an extent allowing all opposed sheets to open and to substantially lay flat when the book is opened.

21. The method of claim 20, including the step of printing on said sheets using a digital printing device.

22. The method of claim 21, said digital printing device comprising a plurality of programmable copy machines.

23. The method of claim 20, wherein is included the step of applying printing to unprinted, notched A and B sheets.

24. The method of claim 20, wherein is included the step of applying tape to the flat spine surface of the book block.

25. A method of producing a book comprising the steps of:

providing a plurality of individual sheets including multiple A sheets and multiple B sheets for fabrication of the book, each of said sheets having a spine-defining margin;

notching said margins of the A and B sheets to present a series of spaced apart, glue-receiving notches along the length thereof that define corresponding sheet tabs between the notches with the tabs in the A sheets being fully offset from the tabs in the B sheets;

positioning the A and B sheets in alternating face-to-face adjacency with the binding margins thereof aligned to cooperatively define a book block having a generally flat spine surface, wherein the tabs of respective A sheets having a B sheet therebetween and the tabs of respective B sheets having an A sheet therebetween are disposed in directly opposed, aligned relationship, such that the notches of each A sheet are fully and directly aligned with respective tabs of adjacent B sheets and the notches of each B sheet are fully and directly aligned with respective tabs of adjacent A sheets, said tabs of the notched sheets each presenting a generally linear outermost edge;

disposing said outermost edges of the tabs in a generally common plane that defines the spine surface; and applying a sufficient amount of flexible adhesive to the generally flat spine surface of the book block to cause adhesive to enter said notches of the A and B sheets and flexibly bond the directly opposed, aligned A sheet and B sheet tabs, respectively, to an extent allowing all opposed sheets to open and to substantially lay flat when the book is opened.

26. The method of claim 25, wherein is included the step of applying printing to the notched A and B sheets.

27. The method of claim 25, wherein is included the step of applying tape to the flat spine surface of the book block.

28. The method of claim 25, including the step of printing on said sheets using a digital printing device.

29. The method of claim 28, said digital printing device comprising a plurality of programmable copy machines.

* * * * *